United States Patent [19]

Wisda

[11] 4,380,704

[45] Apr. 19, 1983

[54] ELECTRICAL SWITCH

[76] Inventor: Michael S. Wisda, 1142 Sheila Ct., Upland, Calif. 91786

[21] Appl. No.: 144,442

[22] Filed: Apr. 28, 1980

[51] Int. Cl.[3] ..... H01H 19/00

[52] U.S. Cl. ..... 307/116; 335/202; 335/206

[58] Field of Search ..... 307/113, 114, 115, 326; 335/202, 205, 206

[56] References Cited

U.S. PATENT DOCUMENTS

| | | | |
|---|---|---|---|
| 3,302,588 | 2/1967 | Bennett | 335/205 X |
| 3,760,312 | 9/1973 | Shlesinger, Jr. | 335/205 |
| 3,976,963 | 8/1976 | Kübler | 335/206 |
| 4,227,236 | 10/1980 | Kübler | 335/206 X |
| 4,292,542 | 9/1981 | Bajka | 307/326 X |

*Primary Examiner*—G. Z. Rubinson
*Assistant Examiner*—James L. Dwyer
*Attorney, Agent, or Firm*—Edward J. DaRin

[57] ABSTRACT

An electrical switch that can be used in corrosive and explosive environments as well as under water. The switch is constructed of reed switches mounted on a printed circuit board. The printed circuit is connected with a power cable and the entire board and elements are encased in a tough, non-corrosive insulating medium. A control shaft mounting a permanent magnet extends through the casing with the magnet mounted on the outside of the casing adjacent the controlled reed switch.

12 Claims, 5 Drawing Figures

ELECTRICAL SWITCH

This invention relates to an electrical switch and, more particularly, to an electrical switch that is completely encased to permit it to be safely used in corrosive environments, around explosive vapors, and under water, without the risk of corrosion, explosions, electrocutions, or electrical shocks.

At the present time there are many types of electrical switches that are commercially available for use in various applications and are housed in various modes. One type of electrical switch that has its contacts hermetically sealed, and that is commercially available, in a magnetically actuated reed switch. The reed switch has been incorporated into a multiplicity of circuits and applications. Typical prior art uses of reed switches are found in U.S. Pat. Nos. 3,012,116, 3,760,312, and 4,041,427. In these prior art devices the reed switch is encapsulated in various forms so as to be magnetically actuated by a permanent magnet mounted nearby, and is defined to be moveable between two positions to correspondently open and close the reed contacts. In all prior art devices of which I am aware the resulting switch has at least a pair of electrically exposed contacts, or conductors, leading to the possibility of creating an arc, or spark, which could be dangerous in certain environments. At the present time there is a need for an electrical switch that is safely operable when used under water, or in corrosive environments, or in an atmosphere having explosive vapors present, without any electrical leakage occurring, and that will not corrode, cause explosions, electrocutions, or electrical shocks.

The present invention provides an improved, effective, and relatively inexpensive electrical switch that provides the aforementioned desired results and that is completely encased whereby no electrical contacts or conductors are exposed to the environment. The electrical switch of the present invention provides electrical switching operations where there is no possibility of generating an arc in the environment in which it is used to thereby make it completely safe for use in an environment of explosive vapors, or under water, or in corrosive environments. The switch is not only constructed and defined so as to be completely encapsulated, but also is defined for a long service life, since the elements of the switch all are made electrically and physically secure before encapsulation. The switch is further advantageously defined so as to prevent any electrical leakage due to cracking of parts resulting from drilling or the like in the manufacturing procedures for the switch. The resulting encapsulated switch includes a conventional reed switch that is not only non-conductive and non-corrosive, but is also virtually indestructible. The lack of exposed metallic elements prevents corrosion, or prevents short circuits under water, or prevents the under water user from receiving an electrical shock or from being electrocuted.

From a structural standpoint the present invention comprehends an electrical switch comprising a conventional, encapsulated magnetically actuated reed switch having individual reed contacts with individual electrical leads each extending outwardly of the encapsulation for the reed switch. The switch includes circuit means connected to the individual leads of the reed switch with the circuit means being connected to a power cable having an insulated sheath and a plurality of individually insulated electrical conductors mounted therein and being individually connected through the circuit means to the reed switch to provide a series connected electrical circuit through the reed switch. Means is provided for forming an unbreakable, electrical insulative body around the reed switch and the circuit means including a portion of the power cable connected with the circuit means for completely encapsulating each of the elements, without any voids therein, to thereby eliminate the possibility of producing an electrical arc between the encapsulated elements that will be exposed to the environment. The electrical switch also includes means mounted on the outside of the insulative body for mounting permanent magnet means adjacent the reed switch to operate the switch. The magnet means is constructed and defined to permit the relative position of the poles of the magnet to be moved between two positions to thereby correspondingly open and close the reed contacts in response to the positions of the magnetic poles of the magnet means and thereby provide the desired electrical switching action. For under water use the power cable may be further characterized as a waterproof cable.

The invention also comprehends a method of constructing an electrical switch having no electrical contacts exposed to the environment to permit the switch to be safely used in corrosive and aqueous environments, including under water. The method of construction includes the steps of providing a printed circuit board having an electrical circuit pattern deposited thereon and then mounting an encapsulated magnetic reed switch on the printed circuit board in an electrical circuit relationship with the electrical circuit pattern thereon. The steps include electrically connecting the individual conductors of a power cable to the circuit pattern on said board to define an electrical circuit through the power cable, electrical circuit pattern and reed switch. The construction method includes encapsulating the entire printed circuit board assembly, including the reed switch, and a portion of the power cable adjacent to the connection of the power cable by flowing an insulative medium thereon so that only the unencapsulated portion of the power cable extends into the environment outside of the encapsulated, hardened assembly. The encapsulation step completely insulates all portions of the printed circuit board assembly to prevent any undesirable electrical interaction between the elements thereof. The construction is completed by mounting a permanent magnet on the outside of the encapsulated printed circuit board assembly to permit the magnet to be magnetically oriented relative to the reed switch to cause the contacts thereof to open and close in accordance with the magnetic orientation of the magnet.

These and other features of the present invention may be more fully appreciated when considered in the light of the following specification and drawings, in which.

Figure 2:
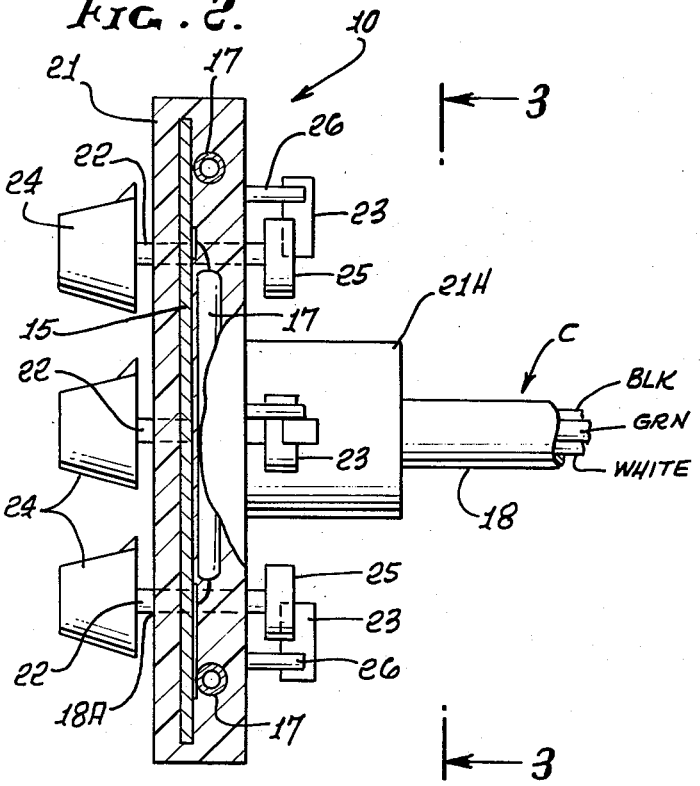
FIG. 2 is a cross sectional view of the electrical switch embodying the present invention taken along the line 2—2 of FIG. 1.
Figure 5:
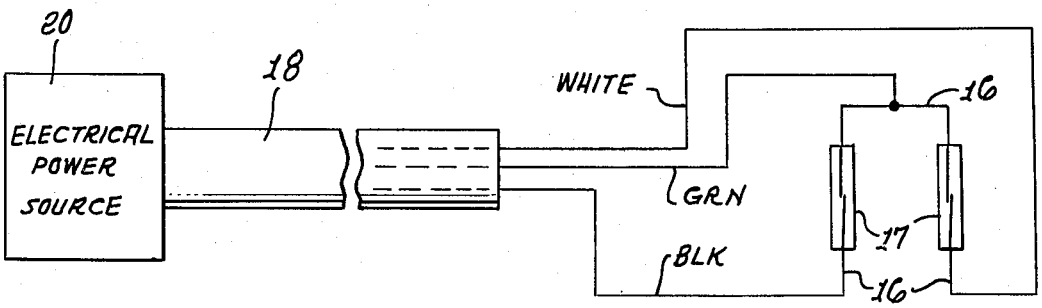
Figure 3:
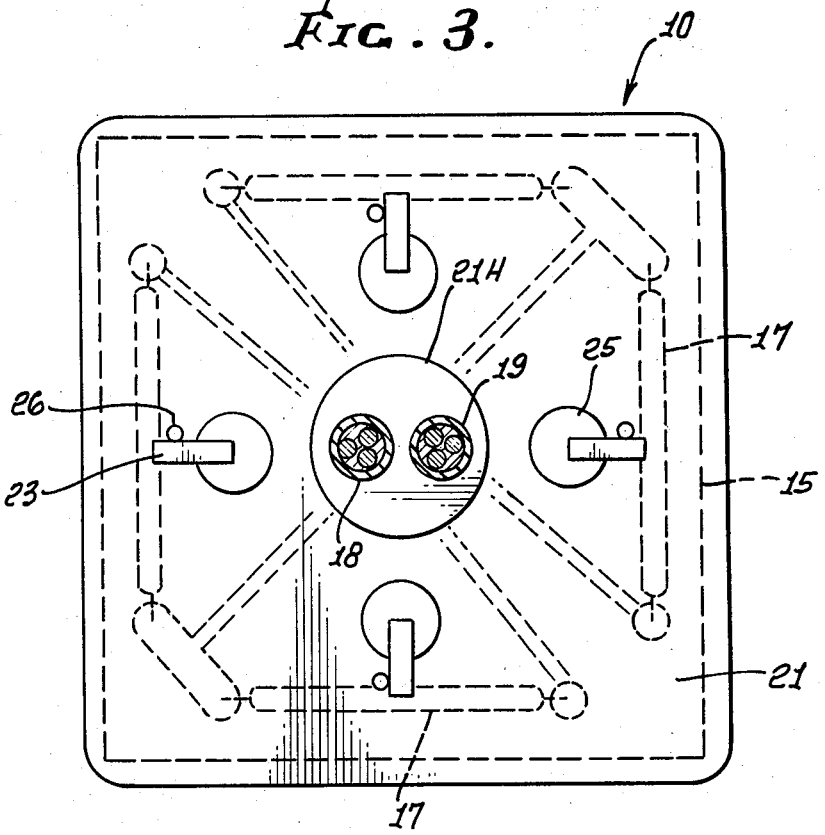
FIG. 3 is a rear view of the electrical switch taken along the line 3—3 of FIG. 2.
Figure 4:
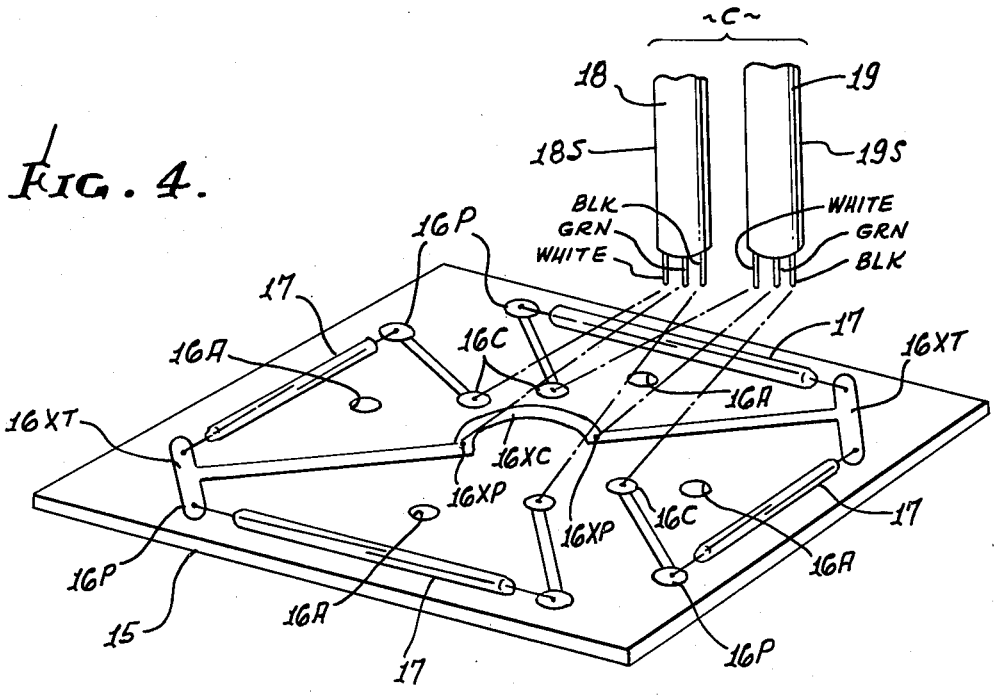

FIG. 4 is an exploded view of the printed circuit board utilized in the electrical switch of FIG. 2 and the electrical connections of the reed switch, printed circuit board electrical pattern, and indicating the connections of the individual conductors of the power cables with the board pattern; and FIG. 5 is an electrical circuit diagram illustrating the basic embodiment of the connections between the reed switches, a power cable, and the printed circuit board electrical pattern, with a remote power source.

Figure 1:
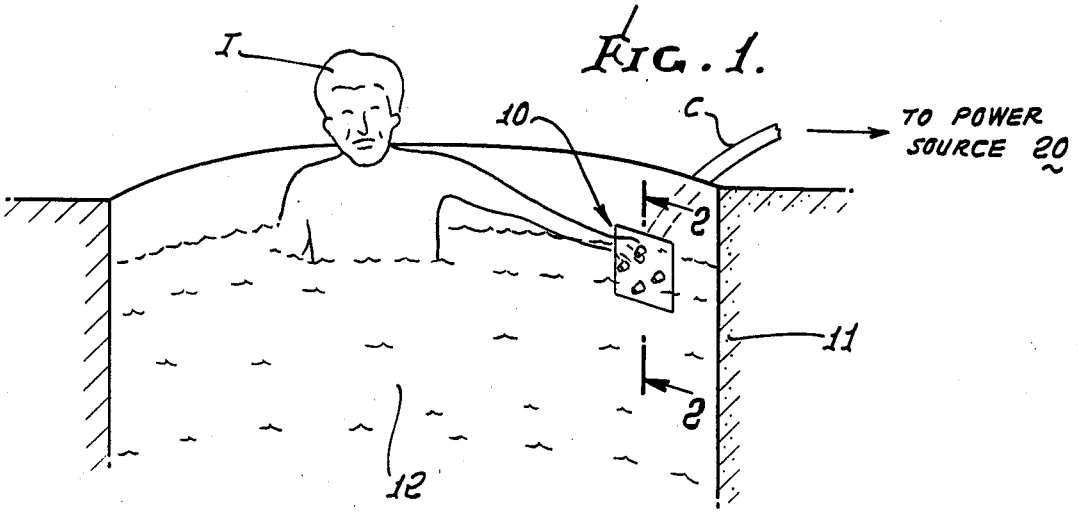
FIG. 1 is a diagrammatic view of an individual in a spa illustrating the electrical switch of the present invention being used when mounted under water.

Now referring to the drawings the detailed construction of the electrical switch 10 will be described. In FIG. 1 the electrical switch 10 is illustrated mounted in a spa or outdoor water tub 11, underneath the water 12. The electrical switch 10 is constructed and defined to completely encase all or the required metallic contacts so that an individual I can operate the electrical switch 10 while the individual is in the water 12 and while the switch 10 is also mounted under the water, without any danger of electrical shock or electrocution. The electrical switch 10 is connected to an electrical power source 20 by means of a waterproof cable C. The cable C also does not have any exposed electrical joints or metallic connections adjacent the point of use. The power source 20 is arranged at a point remote from the point of use on the tub 11 so as to not produce a hazard at the point of use.

The electrical switch 10 basically comprises a printed circuit board 15 having a printed circuit pattern 16 of a preselected configuration deposited on one side thereof and a plurality of magnetic reed switches 17 mounted on the printed circuit board 15 in electrical conducting relationship with the printed circuit pattern 16. The power cable C comprising a pair of power cables 18 and 19 is utilized for providing an electrical connection between the printed circuit pattern 16 on the printed circuit board 15 and the power source 20. The power cables 18 and 19 each have individually insulated conductors, three of which are illustrated, that are electrically connected by soldering to the printed circuit pattern 16 to form a circuit path through the reed switches 17. The entire unit is encapsulated in a tough, non-corrosive, non-conductive, encapsulating medium 21. The printed circuit board 15 and the encapsulating medium 21 are molded with respective apertures 16A and 18A arranged coaxially for receiving a control shaft 22 therethrough for mounting a permanent magnet 23 at one end thereof and on the outside of the encapsulating medium 21.

The construction of the electrical switch 10 can be best appreciated by considering the method of construction. Referring to FIG. 4, initially, it will be noted that the initial step includes the provision of the printed circuit board 15 which is constructed in a conventional fashion of an insulative, plastic medium having the printed circuit conductive pattern 16 deposited on one side thereof. The printed circuit board 15 is provided with the apertures 16A for receiving the switch control shafts 22. The apertures 16A, in accordance with the present invention, are molded into the board at the time the board 15 is molded so that it will be formed integrally with the board proper. This is an important consideration since the drilling of the printed circuit board 15 during this manufacturing phase may cause the board to have cracks therein that would cause electrical leakage when utilized in the extreme environments to which the switch 10 would be exposed. The printed circuit pattern 16 can be of any configuration, and the printed circuit pattern illustrated in FIG. 4 is defined to provide circuit paths through four reed switches 17 to permit the switches to be individually operated. The pattern 16 will be described in more detail hereinafter. The electrical reed switches 17 are electrically and mechanically connected to the conductive pads 16P and 16XT defined for the printed circuit pattern 16 for electrically and mechanically securing the leads extending outwardly of the encapsulated reed switches 17 by means of soldering. The reed switches 17 are mounted so that they are mechanically and electrically secured to the printed circuit board before the encapsulation step. A magnetic reed switch that is commercially available and which has been found to be satisfactory for the purposes of the present invention is a single pole, single throw magnetic reed switch Model DRR-129, manufactured and sold by Hamlin, Inc., of Lake Mills, Wis. The reed switches 17 are conventionally arranged with their reed contacts in an open circuit condition and can be operated to a closed circuit condition by means of a magnetic field.

After the reed switches 17 are mechanically and electrically secured to the printed circuit board 15 the power cables 18 and 19 are electrically connected to the printed circuit board pattern 16. In FIG. 4 the two power cables 18 and 19 are illustrated relative to the portions of the pattern 16 to which they are connected. Each cable 18 and 19 includes individually insulated electrical conductors. The electrical conductors for each cable 18 and 19 are identified by color coding as black, green, and white cables. The cables 18 and 19 are stripped of their insulation to expose the electrical conductors for mechanically and electrically securing them to the printed circuit pattern 16. The basic electrical circuit for the cable 18 is illustrated in FIG. 5. The cable 18 has one end terminated at the electrical power source 20 which is usually at a remote point from the point of use of the switch 10. The cable 18 is illustrated with the white, green and black individual conductors connected up with a pair of reed switches 17 arranged in a parallel circuit relationship by means of the printed pattern 16. Accordingly, the common conductor, or the green conductor, for the cable 18 is connected to the printed circuit conductive path 16 at a common junction so as to provide a series circuit path through the reed switch 17 arranged on the left hand side of the parallel arm, and connected to the black conductor for the cable 18 to the power source 20. The white conductor of cable 18 is connected to the right hand reed switch 17 to complete the circuit through this switch by means of the green conductor at the common junction. The circuit pattern illustrated on the printed circuit board 15 in FIG. 4 is the same, except that it is duplicated on each side of the center of the printed circuit pattern and utilizes the transverse circuit path 16X as a common bridge for each half of the printed circuit pattern illustrated in FIG. 4. The illustrated arrangement permits the two power cables 18 and 19 to be connected to the four magnetic reed switches 17.

For this purpose, the transverse circuit path 16X includes an arcuate portion 16XC substantially centrally thereof providing a junction point 16XP, such as a solder lug, for mechanically and electrically connecting the green conductor for each of the cables 18 and 19 thereto. The circuit path 16X has a transverse portion 16XT at the outer ends for securing one lead for each reed switch 17. The remaining leads for each reed switch 17 is connected to an individual printed circuit pattern 16R having a pad 16P at one end and a pad 16C at the opposite end. The pads 16P are mechanically and electrically connected with the remaining lead of the individual reed switch 17 mounted adjacent thereto as is evident in FIG. 4. The white conductor of cable 18 is connected to a pad 16C to the top left of the conductive pattern 16XC as illustrated in FIG. 4, while the black conductor of the same cable is connected to the pad 16C arranged on the bottom left of the pattern 16XC to complete the circuit through the two reed switches on the left side of the board. The white conductor for the cable 19 is connected to the pad 16C above and to the right of the pattern 16XC with the corresponding black conductor connected to the pad 16C below and to the right of the pattern 16XC along with the green conductor connection to the pattern 16XC, as indicated in FIG. 4. This provides a circuit path through the reed switches 17 mounted on the right side of the board 15.

The power cables 18 and 19 have an insulated sheath thereon which can also be water resistant. The cables 18 and 19 are of commercial, conventional, construction and are readily available with the three insulated conductors mounted within the insulated sheaths 18S and 19S. When the insulated sheaths 18S and 19S are cut through, they will expose the three insulated conductors. The insulation is then further stripped from the individual conductors for permitting the electrical and mechanical connections to the printed circuit pattern 16. Once these electrical and mechanical connections are accomplished, the entire printed circuit board with the power cables connected thereto is encased within the encapsulating medium 21. The encapsulating medium is formed with a hub 21H surrounding the portion of the cables 18 and 19 immediately adjacent the printed circuit board 15. The hub 21H extends a distance outwardly of the adjacent face of the encapsulation medium 18 to completely insulate both the uninsulated portions of the conductors of the cables 18 and 19 as well as a preselected length of the insulated cables. The hub 21H is defined so that there is no possibility of water or gas entering into the central area adjacent the contacts on the printed circuit board 15 by means of a leak through the encapsulation medium 21. The encapsulation medium 21 is a conventional, commercially available, potting material formulated of a pure epoxy compound. One such compound that has been found to be useful for the electrical switch 10 of the present invention is a blend of pure epoxy polyfunctional aliphatic and aromatic materials manufactured and sold by Delta Plastics Company, Inc., of Visalia, Calif. The particular plastic utilized is identified by its Model No. LV54F-9049A&B. The encapsulating medium is cured and dries within a period of 15 to 35 minutes, and when completely cured and hardened exhibits outstanding toughness with excellent physical and electrical properties. In molding the encapsulating medium 18 around the printed circuit board 15 with the elements mounted thereon, it is molded with an aperture 18A coaxial with the aperture 16A on the printed circuit board 15 so as to accept control shaft 22. The environment for molding the encapsulation medium 12 is a vacuum drawn to approximately 90 pounds to eliminate any cavities that may be formed due to air bubbles or the like. This provides a solid, bubble-free encasement.

The construction is then completed by mounting the control shaft 22 through the coaxial apertures 18A and 16A so as to extend completely through the encapsulation medium 21. One side of the medium 21, the side opposite the hub 21H, may include a control knob 24 mounted at one end of the control shaft 22. The other end mounts a magnet rest 25 for the magnet 23. The magnet rest 23 is mounted with a stop 26 for controlling the positions of the permanent magnet 23.

With the above structure in mind, the operation of the electrical switch 10 should be appreciated. It will be appreciated that with the normal position of the permanent magnets 23 and the reed switches 17 the reed switches will be maintained in an open circuit condition. When it is desired to close any one of the switches 17, the individual control shaft 22 is rotated by means of the knob 24 to change the position of the permanent magnet 23 so that its magnetic field will influence the reed switch 17 to cause the reed contacts to close. This switching action will occur within the encapsulation for the magnetic reed switch 17 proper associated with the individual magnet 23 and will not produce an electrical arc that is exposed to the environment. The circuit through the reed switch 17, then, will be completed by means of the individual portion of the printed circuit path 16 back through the individual conductors of the cable 18 or 19 to the power source 20.

In an explosive environment, the cable C is defined to have a continuous, uninterrupted length to extend outside of the explosive environment to the power source 20.

What is claimed is:

1. An electrical switch for use in explosive environments, under water, and the like, comprising a printed circuit board having an electrical circuit pattern deposited thereon, at least a single magnetic reed switch mounted on said board and connected in electrical series circuit relationship with the electrical circuit pattern on said board, the reed switch having switch contacts in a normally open circuit condition, an electrical cable having a plurality of electrical conductors arranged therein in an insulatively spaced relationship, said cable being constructed of an electrical insulative material, and being adapted to have one end of each of the electrical connectors connected to an electrical power source, means for electrically connecting the remaining ends of the individual electrical conductors of the cable in circuit relationship with the electrical circuit pattern of the printed circuit board to provide an electrical circuit path on the printed circuit board through the reed switch to thereby electrically switch the power through the electrical cable in accordance with the electrical circuit condition of the reed switch, means for completely encapsulating the printed circuit board including the circuit pattern thereon and the connected reed switch and a portion of the electrical cable beyond said cable conductor connecting means in an electrical insulative medium to form a solid unit without any voids in the insulative medium to thereby eliminate any exposed electrical contacts externally of the insulative encapsulated medium whereby the encapsulated elements may be completely immersed in an explosive or corrosive environment, under water or the like, said encapsulating medium including an aperture spaced adjacent the reed switch while being spaced from the circuit pattern on the printed circuit pattern and extending through the printed circuit board to permit mounting a control shaft therethrough, a control shaft mounted in said aperture for rotation therein, one end of the control shaft mounting a permanent magnet rotatable with the control shaft to operate the encapsulated reed switch in accordance with the positions of the magnetic poles of the magnet to thereby provide an electrical circuit path through the cable, printed circuit pattern on said board and the closed contacts of the reed switch when the contacts are magnetically operated by said permanent magnet to a closed circuit position.

2. An electrical switch as defined in claim 1 wherein the electrical cable is further characterized as having a waterproof, insulative material.

3. An electrical switch as defined in claim 1 or 2 wherein said electrical insulative encapsulation material is further characterized as being ubreakable and non-corrosive.

4. An electrical switch as defined in claim 1 wherein said magnetic reed switch is a single pole, single throw switch that has the switch contacts hermetically spaced.

5. An electrical switch as defined in claim 1 wherein the printed circuit board is an electrically insulative board having the aperture for the control shaft molded therein.

6. An electrical switch as defined in claim 1 wherein said printed circuit board has an electrical circuit pattern having parallel circuit paths with a reed switch connected to an individual circuit path to provide independent switchable circuits, the parallel paths being electrically connected by means of the individual electrical conductors of said electrical cable, and individual control shafts mounting an individual permanent magnet to operate an individual reed switch.

7. An electrical switch as defined in claim 1 wherein said printed circuit board has a pair of independent electrical circuit patterns with at least a single reed switch connected in series circuit relationship with an individual one of the electrical circuit patterns and the independent electrical circuit paths being connected by means of the individual electrical conductors of said electrical cable, and individual control shafts each mounting a permanent magnet to operate an individual reed switch.

8. An electrical switch as defined in claim 7 wherein said plastic insulative medium is an epoxy compound.

9. A method of constructing an electrical switch having no electrical contacts exposed to the environment to permit the switch to be safely used in corrosive and aqueous environments, including the steps of providing a printed circuit board having an electrical circuit pattern deposited thereon, mounting an encapsulated magnetic reed switch on said board in an electrical circuit relationship with the electrical circuit pattern thereon, electrically connecting the individual conductors of a power cable to the circuit pattern on said board to define an electrical circuit through the power cable, electrical circuit pattern and reed switch, encapsulating the entire printed circuit board assembly including the reed switch and the portion of the power cable adjacent to the connection of the power cable by flowing an insulative medium thereon so that only the unencapsulated portion of the power cable extends into the environment outside of the encapsulated, hardened assembly, the encapsulation step completely insulating all portions of the printed circuit board assembly to prevent any undesirable electrical interaction between the elements thereof, mounting a permanent magnet on the outside of the encapsulated printed circuit board assembly in a fixed position relative to the reed switch to permit the magnet to be controllably magnetically oriented relative to the reed switch to cause the contacts thereof to open and close in accordance with the magnetic orientation of the magnet;

the step of mounting the permanent magnet includes the steps of providing an aperture on the printed circuit board adjacent the location of the reed switch but insulatively spaced therefrom, and the step of encapsulation includes constructing and defining an aperture in axial alignment with the aperture on said board, mounting a control rod through said aligned apertures for rotation therein, and mounting the permanent magnet on one end of the control rod for orienting same with respect to the reed switch.

10. A method of constructing an electrical switch as defined in claim 9 wherein the aperture on the printed circuit board is constructed and defined by molding without any drilling operations to maintain the structural integrity of said board and thereby the possibility of electrical leakage therethrough.

11. A method of constructing an electrical switch as defined in claim 9 including mounting a control knob on the remaining end of the control rod.

12. A method of contructing an electrical switch as defined in claim 9 wherein the step of encapsulation comprises molding a plastic, insulative, resin around said printed circuit board assembly so that upon hardening said assembly provides a non-conductive, non-corrosive, virtually indestructable medium all around said assembly.

* * * * *